US007519192B1

(12) United States Patent
Laycock et al.

(10) Patent No.: US 7,519,192 B1
(45) Date of Patent: Apr. 14, 2009

(54) WIRED CLOTHING AND EARPHONES

(76) Inventors: Logan Laycock, 146 S. Pfeifferhorn Dr., Alpine, UT (US) 84004; Landon Laycock, 146 S. Pfeifferhorn Dr., Alpine, UT (US) 84004; Larry R. Laycock, 146 S. Pfeifferhorn Dr., Alpine, UT (US) 84004

( * ) Notice: Subject to any disclaimer, the term of this patent is extended or adjusted under 35 U.S.C. 154(b) by 445 days.

(21) Appl. No.: 11/224,888

(22) Filed: Sep. 13, 2005

(51) Int. Cl.
*H04R 5/02* (2006.01)

(52) U.S. Cl. ..... 381/301; 381/333; 381/388; 381/370

(58) Field of Classification Search ..... 2/209, 2/906, 209.13, 905; 381/300–301, 309, 333, 381/370, 376, 380, 382, 385, 388, 364
See application file for complete search history.

(56) References Cited

U.S. PATENT DOCUMENTS 5,757,929 A * 5/1998 Wang et al. ..... 381/300
6,567,651 B2 * 5/2003 Whitley ..... 455/90.1
6,707,922 B2 * 3/2004 Tilbury et al. ..... 381/333
6,792,124 B2 * 9/2004 Tilbury et al. ..... 381/333
7,035,422 B1 * 4/2006 Wiener ..... 381/388
7,251,332 B2 * 7/2007 Eves ..... 381/11
2001/0050991 A1 * 12/2001 Eves ..... 381/11
2006/0013429 A1 * 1/2006 Ohta ..... 381/370
2006/0132382 A1 * 6/2006 Jannard ..... 345/8
2006/0182297 A1 * 8/2006 Cyr et al. ..... 381/333
2006/0185062 A1 * 8/2006 Peng et al. ..... 2/209.13
2006/0280322 A1 * 12/2006 Abe ..... 381/300

FOREIGN PATENT DOCUMENTS

WO WO 2005022872 A1 * 2/2005
WO WO 2005045110 A1 * 5/2005

* cited by examiner

*Primary Examiner*—Suhan Ni
*Assistant Examiner*—Ryan C Robinson

(57) ABSTRACT

The present invention provides for various embodiments of a combined garment and earphones. The combined garment and earphones includes a garment having a series of elongate internal passageways. Partially enclosed within the series of elongate internal passageways is a conductive wire assembly. The conductive wire assembly includes a first length of wire leading to at least one earpiece having a transducer for emitting audio into a user's ear, and a second length of wire leading to a connector configured to be communicatively coupled to an audio device. Finally, a retractable dial is coupled to the garment, wherein a portion of the conductive wire assembly travels through the retractable dial. The retractable dial is configured to selectively retract at least a portion of the first end of the conductive wire assembly.

11 Claims, 5 Drawing Sheets

WIRED CLOTHING AND EARPHONES

CROSS-REFERENCE TO RELATED APPLICATIONS

Not applicable.

BACKGROUND OF THE INVENTION

1. The Field of the Invention

The present invention relates to portable audio systems. More particularly, embodiments of the invention relate to combined wired clothing and earphones.

2. The Relevant Technology

Recently, the use of portable audio devices has increased dramatically. Examples of audio devices include, but are not limited to, portable radios, mp3 players, iPods, Discmans, Walkmans, cellular phones, personal digital assistants (PDAs), mini disks, portable internet devices, two-way radios, and other similar portable listening devices.

With today's high-paced and active lifestyles, more and more people are turning to hands-free audio devices and earphones. This is particularly true where safety is a concern, such as when people are driving, working, or performing other tasks that require the use of both hands. Likewise, people turn to hands-free audio devices and earphones when they are exercising. For example, jogging, skiing, snowboarding, cycling, skateboarding, and performing yard work and housework are all common activities where participants are often seen wearing earphones.

Generally, one desiring mobility while listening to an audio device is required to place a portable audio device in his or her pocket. Typically, the user connects a set of earphones having a wire that stretches from the audio device to the miniature speakers (i.e., earbuds) near the listener's ears. Normally, the wire connecting the audio device to the earbuds is exposed, and can easily be caught or snagged during the listener's movements.

To resolve this, many listeners have run the wire inside of the their clothing. Other manufacturers have designed clothing wherein the wiring is integrated into the clothing of the listener, where headphones or earbuds exit the user's clothes so that the user can place the headphones near his or her ears. However, in such designs the user often has little control over the length of the wiring between the user's clothing and the actual headphones or earbuds.

BRIEF SUMMARY OF THE INVENTION

The present invention relates to clothing having an integrated audio system. Embodiments of the invention disclose various techniques for facilitating the use of portable audio devices and earphones by enclosing the wiring for the earphones within the clothing of the user, and by providing retractable dials for controlling the length of the wiring leading to the earpieces of the earphones. In one exemplary embodiment, a hooded garment integrates a set of earphones by threading a portion of the earphone wiring through an elongate internal passageway within the hood of the garment. By threading the wiring of the earphones through the hood of the garment, a user is able to utilize the earphones as a drawstring, in addition to their traditional listening purpose.

The present invention also relates to a garment having an integrated set of earphones in combination with a retractable dial for controlling the length of the earphones. The wiring for the earphones is at least partially located within a series of elongate internal passageways located within the garment.

The wires leading to the earpieces travel through the retractable dials, and the retractable dials are able to selectively retract the wires so as to control the length of the earpieces. The present invention provides for the use of a single retractable dial for controlling the length of either one or two earpieces. In addition, the present invention relates to the use of multiple retractable dials for controlling the length of up to two earpieces, and for controlling the length of the wire leading to a connector that is configured for connecting to an audio device.

In one exemplary embodiment, internal chambers are also located within the garment for holding audio devices. The elongate internal passageways may connect to the internal chambers for providing an integral connection between the earphones and the audio devices.

Embodiments of the present invention relate to all types of clothing. In one exemplary embodiment, a hat is equipped with a series of elongate internal passageways having the wiring of earphones traveling therethrough. The hat is also equipped with at least one retractable dial for controlling the length of the wiring leading to the earpieces.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
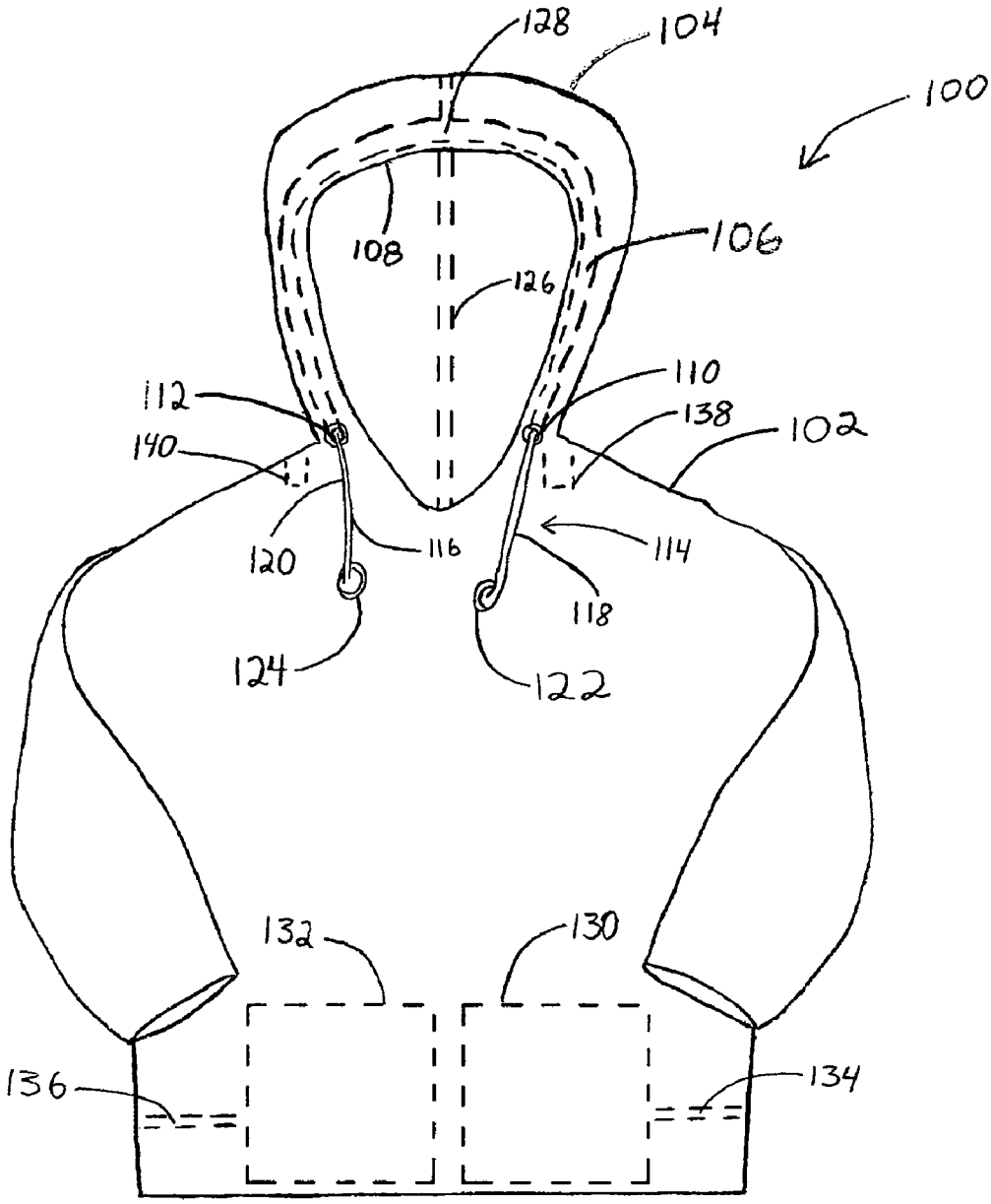
FIG. 1 illustrates a hooded garment having earphones as a drawstring.

FIG. 1 illustrates a combined garment and earphones 100, in accordance with the present invention. Garment and earphones 100 includes a garment 102 having a hood 104 that is sized to be worn over a users head. In one embodiment, hood 104 is sized such that a user can either wear the hood on his or her head, or may choose to remove the hood from his or her head, allowing the hood to hang down the user's upper back. Although garment 102 is portrayed as a hooded sweatshirt, garment 102 may include any number of articles of clothing having a hood, including, but not limited to, sweatshirts, jackets, sweaters, coats, trench coats, blouses, t-shirts, and the like.

Hood 104 is configured to have an elongate internal passageway 106 along the border 108 of the hood. At the two opposing ends of passageway 106 are located a left aperture 110 and a right aperture 112 (i.e., right and left from the perspective of the user). Left and right apertures 110 and 112 are configured to allow a drawstring to be threaded through passageway 106, having the two ends of the drawstring exposed. Passageway 106 may be configured in a similar fashion as a drawstring passageway would normally be configured on a conventional hooded sweatshirt, coat, or jacket.

Combined garment and earphones 100 of FIG. 1 also includes a set of earphones 114. Earphones 114 include a conductive wire assembly 116 that passes through passageway 106. Conductive wire assembly 116 includes a left length of wire 118 and a right length of wire 120. Left length of wire 118 exits passageway 106 through left aperture 110, and right length of wire 120 exits passageway 106 through right aperture 112. Conductive wire assembly 116 and passageway 106 are configured to allow at least a portion of conductive wires assembly 116 to slide back and forth within passageway 106. This slideable configuration allows a user to pull at the conductive wire assembly to tighten hood 104 around the user's face, similar to a conventional drawstring.

Earphones 114 also include a left earpiece 122 and a right earpiece 124 configured to be worn in close proximity to the left and right ears of the user. Earpieces 122 and 124 include traditional transducers that receive an electrical signal from an audio device and use speakers to convert the signal into audible sound waves.

In one embodiment, as show in FIG. 1, left and right earpieces 122 and 124 are conventional earbuds that may be worn within the cavity of a user's ears, directly outside of the ear canal. Several other types of earpieces may be employed, including, but not limited to, circumaural, supra-aural, canal-phones, and the like. Some types of earpieces may require an apparatus to secure the earpieces to the ear. In such a case, a headband or neckband may be required. However, headbands and neckbands may be awkward and bulky. In another embodiment, the earpieces also include a clip for securing the earpiece directly to the ear. Various types of earpieces and securing devices may be employed that are not specifically disclosed herein, but nevertheless fall within the scope of the present invention.

Earphones 114 further include an audio connection (not shown) for coupling earphones 114 to an audio device (not shown), such as an mp3 player or Discman®. Various types of physical connections may be employed, including, but not limited to, mono or stereo jack plugs, RCA jacks, tip ring sleeve connectors, and the like. Furthermore, various types of wireless interfaces may be employed to establish the connection between the audio device and earphones 114, including, but not limited to, all types of RF transmitters and receivers, Bluetooth® transmitters and receivers, and the like.

In one embodiment, left and right earpieces 122 and 124 transmit the same signal, i.e., a mono signal. In another embodiment, left length of wire 118 and right length of wire 120 of earphones 114 are divided into left and right audio channels, thereby enabling stereo sound to be transmitted through left and right earpieces 122 and 124.

Garment 102 may further include a second elongate internal passageway 126. Passageway 126 may be used to house the portion of the conductive wire assembly leading to the connector, described above. Therefore, in the embodiment illustrated in FIG. 1, left length of wire 118 travels through the left portion of passageway 106, right length of wire 120 travels through the right portion of passageway 106, and the right and left lengths are joined at the top center portion 128 of passageway 106. At top center portion 128 of passageway 106, the portion of the conductive wire assembly leading to the connector is threaded through passageway 126, which travels around the top and down the back of hood 104.

In one embodiment, passageway 126 leads to at least one internal chamber 130 or 132 located on garment 102. Internal chambers 130 and 132 are sized and configured for housing an audio device, such as an mp3 player or a Discman®. Therefore, in one embodiment, internal chambers 130 and 132 are integrally connected to passageway 126 for providing an internal link between the connector of earphones 114 and the audio device housed within internal chamber 130 or 132. In the embodiment shown in FIG. 1, internal chambers 130 and 132 are located on the lower front portion of garment 102. Internal chamber 130 and 132 are internally linked to passageway 126 by internal passageways 134 and 136, which wrap around the sides of garment 102.

Although the embodiment of FIG. 1 portrays passageway 126 traveling down the back of garment 102, and splitting into passageways 134 and 136 which wrap around to the front of garment 102, where internal chambers 130 and 132 are located, various other configurations may be employed. For example, passageway 126 may lead to an internal chamber located in the sleeve of the user, the shoulder, the hood, the back, or the front of garment 102.

In another embodiment, passageway 126 need not be linked to an internal chamber housing an audio device. Instead, passageway 126 may lead to a wireless receiver located anywhere on garment 102 for receiving an RF signal to be converted to an audio signal and emitted through earpieces 122 and 124.

In another embodiment, passageway 126 is not necessary at all. In such an embodiment, a small audio device may be located directly in or near hood 104, providing audio to headphones 114. Alternatively, a wireless receiver may be located directly in or near hood 104.

The internal chambers may be accessible to the user either from the outside or the inside of garment 102. For example, internal chambers 130 and 132 may be located within the internal lining of a coat or jacket, and may be accessible to the user by opening a zipper or Velcro®. Therefore, the user can easily access the internal chambers and switch out various audio devices. Garment 102 may include only one internal chamber, or may include many internal chambers. Where garment 102 includes many internal chambers, all of the internal chambers may be linked with internal passageways, each chamber having a separate wire leading to a connector to allow multiple audio devices to be connected to headphones 114.

In the embodiment illustrated in FIG. 1 and described above, neither the audio device nor earphones 114 need be exposed outside of the user's garment 102, other than the wires leading to earpieces 122 and 124. This provides convenience to the user, who no longer needs to worry about snagging his or her earphone wires while engaging in normal activities. Furthermore, wire assembly 116 acts as a drawstring for hood 104, thereby serving both a functional and an aesthetic purpose.

In one embodiment, passageways 106, 126, 134, and 136 are configured to allow a user to selectively open the passageways and remove earphones 114 and wiring assembly 116. A user may desire to remove wiring assembly 116 and earphones 114 when the earphones are not in use, or when garment 102 is to be washed. One manner of allowing passageways 106, 126, 134, and 136 to be selectively opened is to line each of the passageways with Velcro® or zippers, which can be easily opened and closed. It may be desirable to configure the passageways to be opened from the inside of garment 102, so that the seams for the passageways are less visible from the outside.

In another embodiment, garment 102 includes one or more pockets 138 and 140 near hood 104, which are sized to hold earpieces 122 and 124 while not in use. Alternatively, a single pocket may be placed in garment 102 near the neck for holding both earpieces 122 and 124.

Figure 2:
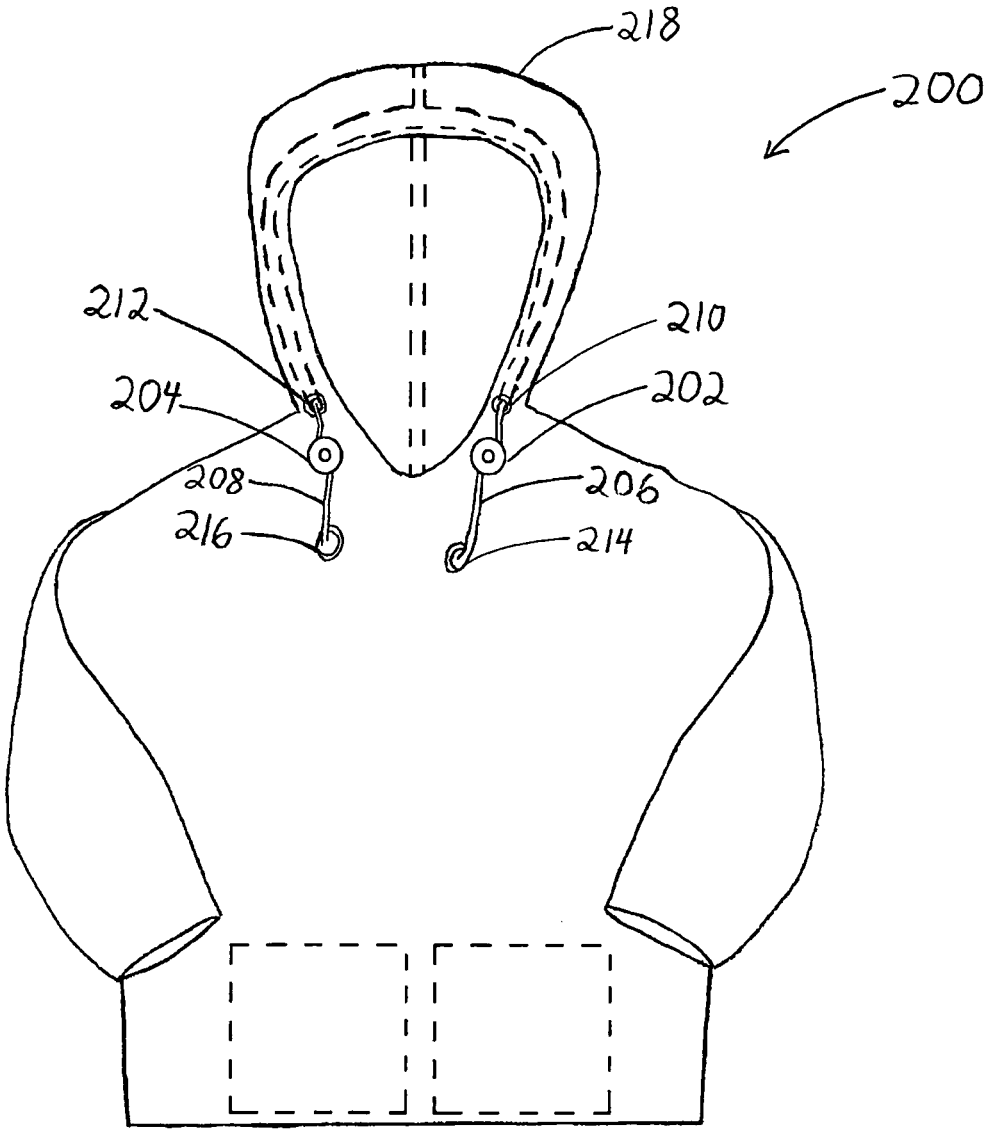
FIG. 2 illustrates the hooded garment of FIG. 1, also having two retractable dials for controlling the length of the earphone wires.

FIG. 2 illustrates another embodiment of a combined garment and earphones 200, in accordance with the present invention. Combined garment and earphones 200 of FIG. 2 is similar to that of FIG. 1, but further includes a left retractable dial 202 and a right retractable dial 204. Retractable dials 202 and 204 are configured and positioned such that portions of the left and right lengths of wire 206 and 208 travel through the retractable dials. More specifically, the portions of left and right lengths of wire 206 and 208 between the left and right apertures 210 and 212 and the left and right earpieces 214 and 216 travel through retractable dials 202 and 204.

Left and right retractable dials 202 and 204 are configured to selectively retract at least a portion of left and right lengths of wire 206 and 208, respectively. In other words, a user can operate retractable dials 202 and 204 to draw part of left and right wires 206 and 208 into the dials, thus decreasing the length of the exposed wires, or the user can extend the length of the wires by pulling the wires out of the retractable dials. Retractable dials 202 and 204 can be controlled by buttons, switches, knobs, or any other control mechanism. One technique for retracting the wires is to include a spring-load mechanism within the retractable dials so that the dials are under constant tension. By pressing a button or other control mechanism, the wire automatically retracts into retractable dial 202 or 204. The user may simply pull at the wire to slide the wire out of retractable dial 202 or 204 in order to lengthen the wire.

In one embodiment, retractable dials 202 and 204 are configured to selectively retract left and right lengths of wire 206 and 208 from only one direction. For example, retractable dials 202 and 204 may be configured to retract lengths of wire 206 and 208 only from the direction of left and right apertures 210 and 212. In such an embodiment, the user would be able to tighten or loosen hood 218 around his or her face by retracting wire lengths 206 and 208 from the direction of apertures 210 and 212. Alternatively, retractable dials 202 and 204 may be configured to retract lengths of wire 206 and 208 only from the direction of left and right earpieces 214 and 216. In such an embodiment, the user would be able to eliminate slack in the wire between retractable dials 202 and 204 and earpieces 214 and 216.

In another embodiment, retractable dials 202 and 204 are configured to selectively retract left and right lengths of wire 206 and 208 from two directions. In such an embodiment, the user could retract or extend the wire in both of the directions described above, thereby completely eliminating excess slack in the wire both within hood 218 and leading to earpieces 214 and 216.

Although FIG. 2 is provided as an example of a garment in combination with integrated earphones and retractable dials, the present invention's use of retractable dials is not limited to hooded garments. In general, the present invention includes all garments having integrated earphones in combination with retractable dials used to control the length of the earphones. Hence, one embodiment of the present invention provides for a combined garment and earphones, including a garment having a series of elongate internal passageways. The elongate internal passageways may be similar in form to those described in FIGS. 1 and 2. The combined garment and earphones also includes a conductive wire assembly that is at least partially enclosed within the elongate internal passageways. The conductive wire assembly includes at least first length of wire exiting the elongate internal passageway and leading to at least one earpiece having a transducer for emitting audio into a user's ear. The conductive wire also includes a second length of wire leading to a connector configured to be communicatively coupled to an audio device. The combined garment and earphones also includes a first retractable dial that is coupled to the garment. At least a portion of the first end of the conductive wire assembly travels through the first retractable dial, and may be selectively retracted into the first retractable dial.

As mentioned previously, while FIGS. 1 and 2 illustrate a hooded garment, various other types of garments may also benefit from the use of the integrated earphones and retractable dials described in the previous paragraph. By way of example and not limitation, the garment of the present example may include any number of articles of clothing, including hats, shirts, pants, coats, jackets, and the like, wherein the article of clothing includes a series of elongate internal passageways, a wire assembly having at least one earpiece, and at least one retractable dial for controlling the length of certain portions of the wire assembly, as described herein.

Figure 4:
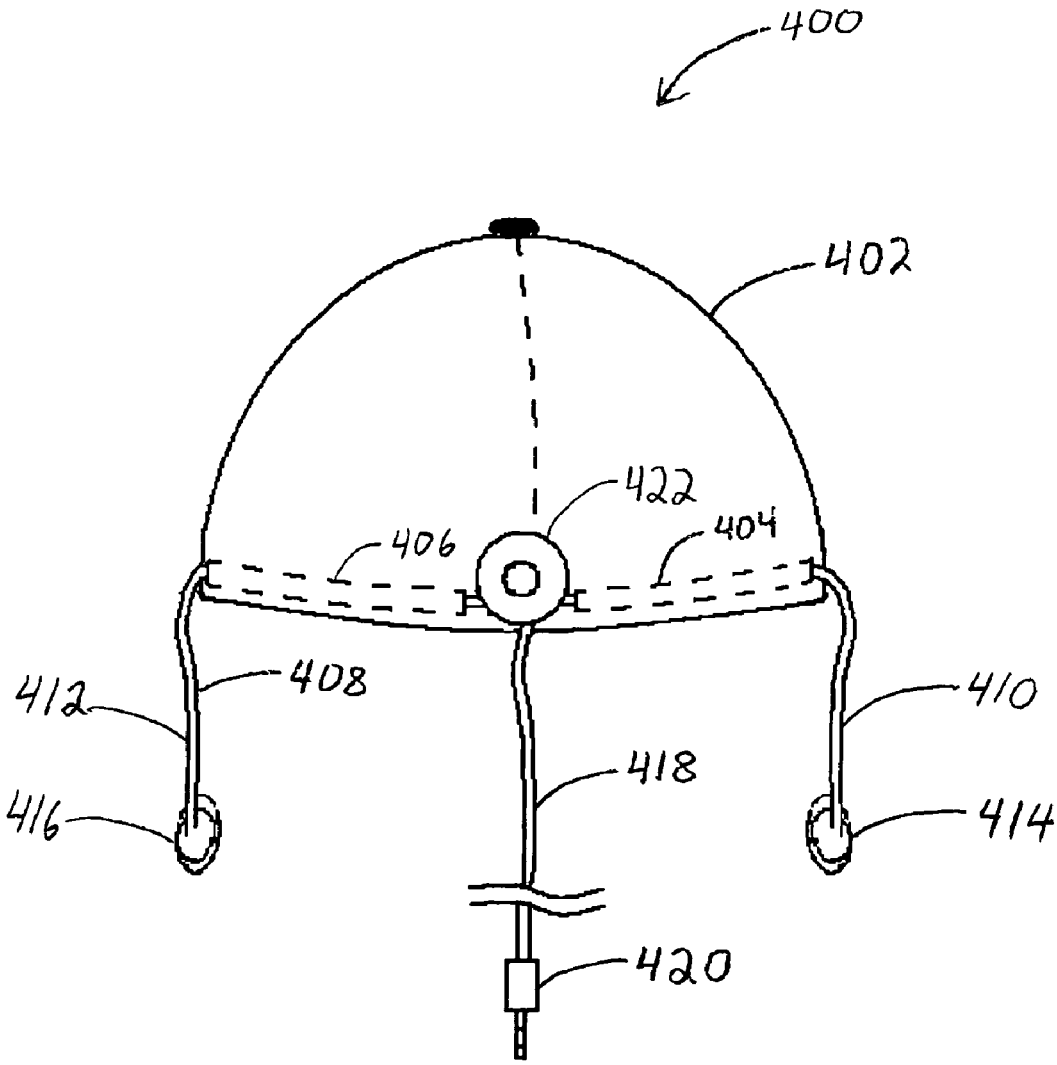
FIG. 4 illustrates an alternative embodiment of a hat having integrated wiring and a retractable dial.

In one embodiment of the present example, a single retractable dial is employed to control the length of a single length of wire (called "the first length of wire") leading to a single earpiece. In another embodiment, a third length of wire leading to a second earpiece is added to the conductive wire assembly. The same retractable dial is configured to selectively retract both the first length of wire leading to the first earpiece and the third length of wire leading to the second earpiece. In this embodiment, the second length of wire leading to the connector enters the retractable dial. This second length of wire splits into the first and third lengths of wire leading to the two earpieces, and the first and third lengths of wire leave the retractable dial. The retractable dial has the ability to control both of the lengths of wire leading to the two earpieces. Because only one retractable dial is used to control the lengths of the two wires leading to the earpieces, it may be beneficial to attach the retractable dial to the garment in a central location on the garment, such as near the front-center or rear-center of the neck of a shirt, jacket, coat, or hat. Although the present embodiment can be implemented in any garment, one example illustrating the present embodiment as implemented in a hat is shown in FIG. 4, which will be described in detail below.

In yet another embodiment of the present embodiment, the combined garment and earphones also includes a second retractable dial coupled to the garment. This embodiment is similar to that of the previous paragraph, except that in this embodiment, the two lengths of wire leading to the two earpieces travel through separate retractable dials. Each retractable dial independently controls the length of wire leading to the two earpieces. Because two retractable dials are used to control two wires, it may be beneficial to attach each retractable dial to the garment at locations close to a user's ears, such as near the shoulders of a shirt, jacket, or coat, or on the sides of a hat above the user's ears.

As previously described, the communicative coupling used to transmit an audio signal from the audio device to the earphones may include any number of connectors, including but not limited to, a physical electronic connection, and a wireless connection.

Similar to the hooded garment of FIG. 1, the garment of the present example may also include at least one internal chamber for housing an audio device. Similarly, the garment of the present example may also include at least one pocket for housing one or more retractable dials and/or earpieces.

Figure 3A:
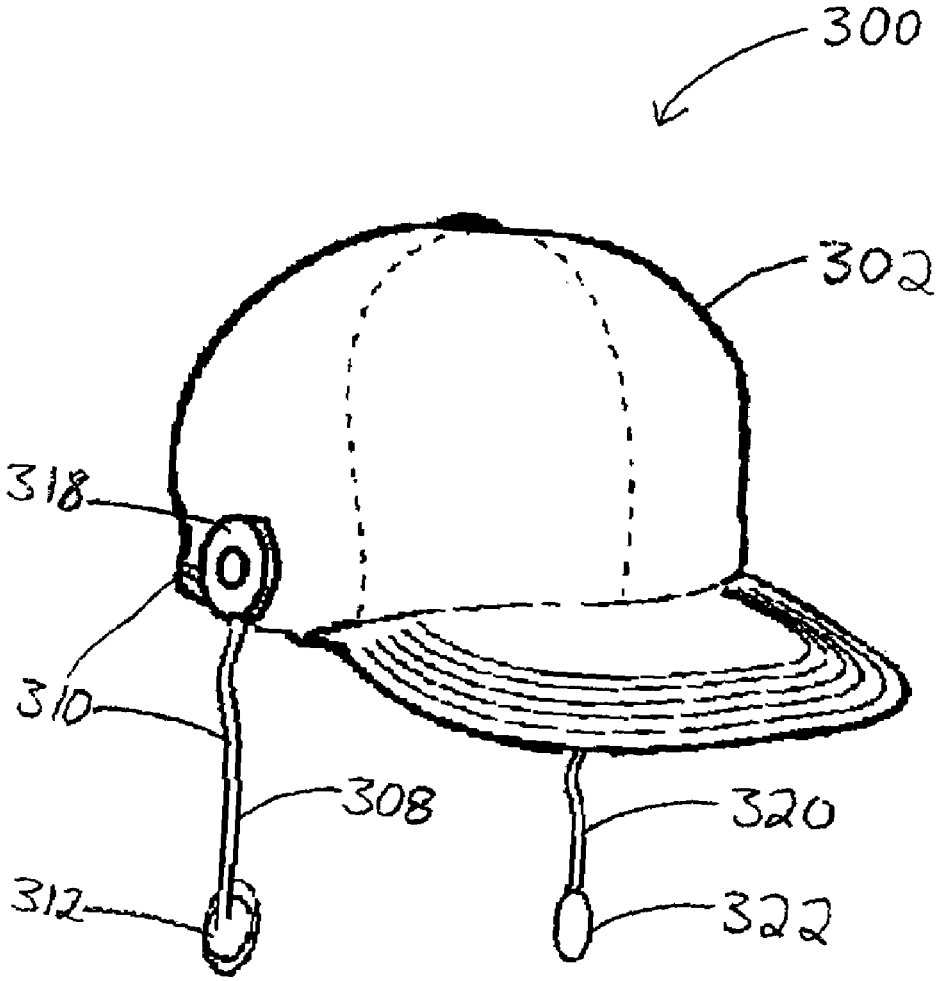
FIG. 3A illustrates a perspective view of a hat having integrated wiring and retractable dials.
Figure 3B:
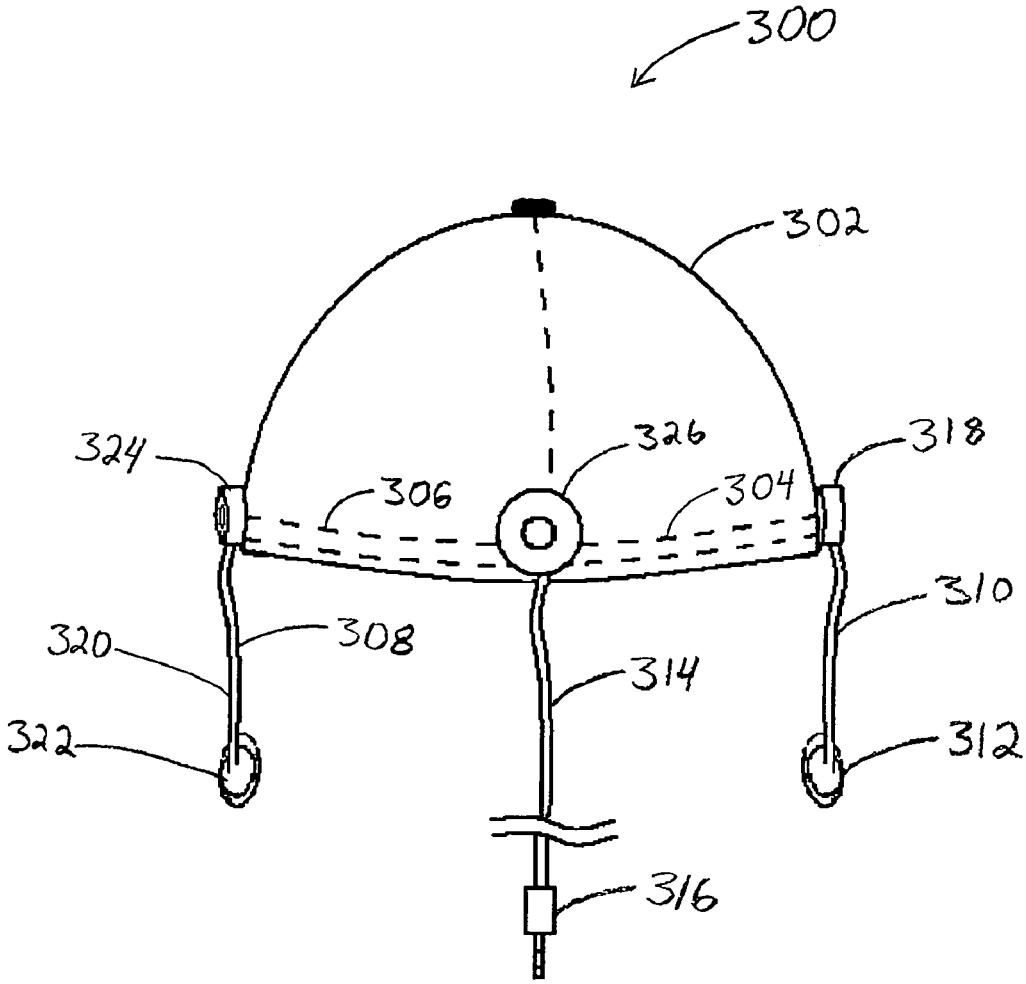
FIG. 3B illustrates a rear view of the hat of FIG. 3A.

As mentioned previously, the present invention includes the combination of a garment, earphones, and retractable dials on all types of articles of clothing. FIGS. 3A and 3B illustrate one particular example of a combined hat and earphones 300. FIG. 3A is a perspective view of combined hat and earphones 300, and FIG. 3B is a rear view of combined hat and earphones 300. Combined hat and earphones 300 includes a hat 302 sized to be worn on the head of a user. The hat includes at least one elongate internal passageway 304 and 306. Although FIGS. 3A and 3B portray a baseball hat, the term "hat" as used herein includes all head coverings, including, but not limited to, baseball caps, snow caps, "beanies", all types of helmets, visors, and the like.

Combined hat and earphones 300 also includes a conductive wire assembly 308 that is at least partially enclosed within internal passageways 304 and 306. Conductive wire assembly 308 includes a first length of wire 310 leading to a first earpiece 312 having a transducer for emitting audio. Conductive wire assembly further includes a second length of wire 314 leading to a connector 316 configured to be communicatively coupled to an audio device (not shown). Although FIG. 3B shows a standard stereo jack plug 316, any type of connector may be used, including all types of electrical connections and wireless connections.

Combined hat and earphones 300 also includes a first retractable dial 318 that is coupled to hat 302 near a first ear of the user. A portion of first length of wire 310 travels through first retractable dial 318, which is configured to selectively retract at least the portion of the first length of wire leading to first earpiece 312. Retractable dial 318 functions in a similar manner as those described in previous examples.

Combined hat and earphones 300 may further include a third length of wire 320 leading to a second earpiece 322, also having a transducer for emitting audio. A second retractable dial 324 may also be coupled to hat 302 near a second ear of the user. A portion of third length of wire 320 travels through second retractable dial 324 in a similar manner as first length of wire 310 and retractable dial 318. Second retractable dial 324 is similarly configured to selectively retract at least the portion of third length of wire 320 leading to second earpiece 322.

Combined hat and earphones 300 may also include third retractable dial 326 coupled to hat 302 near the rear portion of the hat. A portion of second length of wire 314 travels through third retractable dial 326 in a similar manner as the other retractable dials. Third retractable dial 326 is similarly configured to selectively retract at least the portion of second length of wire 314 leading to connection 316.

Although FIGS. 3A and 3B portray retractable dials 318, 324, and 326 as being exposed for purposes of illustrating the present embodiment, the retractable dials may be hidden within internal chambers (not shown) of hat 302. Likewise, pockets may exist on hat 302 for storing earpieces 322 and 312 while not in use.

FIG. 4 illustrates an alternative embodiment for a combined hat and earphones 400. Combined hat and earphones 400 includes a hat 402, also having a elongate internal passageways 404 and 406. A conductive wire assembly 408 is at least partially enclosed within elongate internal passageways 404 and 406. Conductive wire assembly 408 also includes first and second lengths of wire 410 and 412 leading to first and second earpieces 414 and 416, respectively. Each earpiece includes a transducer for emitting audio. Conductive wire assembly 408 also includes a third length of wire 418 leading to a connector 420 configured to be communicatively coupled to an audio device.

Combined hat and earphones 400 includes a single retractable dial 422 coupled to hat 402. A portion of first and second lengths of wire 410 and 412 travels through retractable dial 422. Retractable dial 422 is configured to selectively retract at least the portion of first and second lengths of wire 410 and 412 leading to first and second earpieces 414 and 416. Therefore, a user is able to extend and retract both earpieces 414 and 416 with only a single retractable dial 422, instead of using two or more independent dials, as is illustrated in FIGS. 3A and 3B. Retractable dial 422 may also be configured to selectively retract at least the portion of third length of wire 418 leading to connector 420.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A combined garment and earphones, comprising:

a garment having a hood sized to be selectively worn over a user's head, the hood including an elongate internal passageway along the border of the hood, and having left and right apertures at each end of the passageway;

earphones, comprising:

a conductive wire assembly passing through the elongate internal passageway and having left and right lengths of wire exiting through the left and right apertures, respectively, wherein at least a portion of the conductive wire assembly is slideable within the passageway, and acts as a drawstring for the hood;

a left and a right earpiece configured to be worn in close proximity to the left and right ears of the user, the earpieces being electronically coupled to the left and right lengths of wire, respectively, and including transducers for emitting audio into the ears of the user; and a connection between the earphones and an audio device for supplying an audio signal from the audio device to the earphones.

2. The combined garment and earphones as recited in claim 1, wherein the earphones further include left and right audio channels, the left channel being transmitted through the left length of wire, and the right channel being transmitted through the right length of wire.

3. The combined garment and earphones as recited in claim 1, further comprising a second elongate internal passageway for housing the portion of the conductive wire assembly leading to the connector.

4. The combined garment and earphones as recited in claim 1, wherein the elongate internal passageways are configured to be selectively opened to allow removal of the earphones and the conductive wire assembly.

5. The combined garment and earphones as recited in claim 4, further comprising Velcro® strips for selectively sealing the elongate internal passageways.

6. The combined garment and earphones as recited in claim 1, further comprising at least one internal chamber located on the garment for housing the audio device.

7. The combined garment and earphones as recited in claim 6, wherein the at least one internal chamber is integrally connected to a second elongate internal passageway for providing an internal link between the audio device and the conductive connector of the earphones.

8. The combined garment and earphones as recited in claim 1, further comprising:

a left retractable dial, wherein a portion of the left length of wire between the left aperture and the left earpiece travels through the left retractable dial, and wherein the left retractable dial is configured to selectively retract at least a portion of the left length of wire; and a right retractable dial, wherein a portion of the right length of wire between the right aperture and the right earpiece travels through the right retractable dial, and wherein the right retractable dial is configured to selectively retract at least a portion of the right length of wire.

9. The combined garment and earphones as recited in claim 8, wherein the left and right retractable dials are configured to selectively retract the right and left lengths of wire from the direction of the earpieces.

10. The combined garment and earphones as recited in claim 8, wherein the left and right retractable dials are configured to selectively retract the right and left lengths of wire from the direction of the left and right apertures.

11. The combined garment and earphones of claim 1, wherein the connection is selected from the group consisting of a physical electronic connection, and a wireless connection.

* * * * *

UNITED STATES PATENT AND TRADEMARK OFFICE

CERTIFICATE OF CORRECTION

PATENT NO. : 7,519,192 B1
APPLICATION NO. : 11/224888
DATED : April 14, 2009
INVENTOR(S) : Laycock et al.

It is certified that error appears in the above-identified patent and that said Letters Patent is hereby corrected as shown below:

Column 3
Line 26, change "show" to --shown--

Column 5
Line 67, change "least" to --least a--

Column 7
Line 19, change "assembly" to --assembly 308--
Line 29, change "wire" to --wire 310--
Line 58, change "a elongate internal passageways" to --at least one elongate internal passageway--

Signed and Sealed this

Thirteenth Day of October, 2009

David J. Kappos

David J. Kappos
*Director of the United States Patent and Trademark Office*